US005392713A

United States Patent [19]

Brown et al.

[11] Patent Number: 5,392,713

[45] Date of Patent: Feb. 28, 1995

[54] SHOCK INSENSITIVE INITIATING DEVICES

[75] Inventors: Jerry S. Brown, Woodford, Va.; John A. Conkling, Chestertown, Md.

[73] Assignee: The United States of America as represented by the Secretary of the Navy, Washington, D.C.

[21] Appl. No.: 195,250

[22] Filed: Feb. 14, 1994

[51] Int. Cl.[6] ..... F42B 3/00

[52] U.S. Cl. ..... 102/322; 102/275.11; 149/108.6

[58] Field of Search ..... 102/322, 275.11; 149/108.6

[56] References Cited

U.S. PATENT DOCUMENTS

| | | | |
|---|---|---|---|
| 3,509,820 | 5/1970 | Fitch et al. | 102/322 X |
| 3,759,216 | 9/1973 | Sanders et al. | 116/124 B |
| 4,762,067 | 8/1988 | Barker et al. | 102/313 |
| 5,035,756 | 7/1991 | Covino | 149/37 |

*Primary Examiner*—Peter A. Nelson
*Attorney, Agent, or Firm*—Jacob Shuster

[57] ABSTRACT

The invention relates to a shock insensitive explosive train initiating device including a thin elongated metal casing containing a quantity of hydrated metal picrate therein, a thermite igniter composition disposed adjacent to the hydrated metal picrate charge and an ignition means selected from ignition means consisting of an electric match and a length of fuze cord. In a specific example, the hydrated metal picrate charge is barium picrate hydrate which may be disposed in an open (FIG. 1) or a sealed (FIG. 2) copper or aluminum casing. In the embodiment of FIG. 3, a tin/zinc alloy, protective, safety cover is disposed over a portion of the hydrated metal picrate. This safety cover has a low melting point (200° C.) and is adapted to melt in the event of a fire to thereby "unconfine" the hydrate metal picrate charge prior to it reaching explosion temperature of approximately 341° C.

20 Claims, 1 Drawing Sheet

SHOCK INSENSITIVE INITIATING DEVICES

ORIGIN OF THE INVENTION

This invention was made jointly by a Government employee and by consultants in the performance of work under a U.S. Navy Contract and the U.S. Government, accordingly, has certain rights in the invention.

BACKGROUND OF THE INVENTION

Explosive initiating devices generally employ an explosive train wherein a number of explosive components are arranged in tandem from the very sensitive to very insensitive. The sensitive explosive initiator components can be activated from a very small electrical or mechanical stimulus. The most common initiating devices presently employed in explosives detonation employ sensitive primary explosive initiator components such as lead azide or lead styphnate. In an explosive train, the output from one of these very sensitive explosives then activates explosives which are less sensitive and therefore safer to handle.

The explosive components in an explosive train are arranged from the very sensitive to very insensitive with the most sensitive components being the smaller amounts and the least sensitive being the main charge. The primary disadvantage of initiating devices containing lead azide or lead styphnate is that these sensitive explosives can be accidentally detonated if exposed to shock or static electricity. Other disadvantages imposed by the sensitive nature of these initiators include the requirements for special handling, storage, and transportation. There is thus a definite need in the art for less sensitive explosive initiators that retain the reliability of the sensitive lead azide and lead styphnate based initiators.

A primary explosive is an explosive with sensitivity such that a small amount of explosive (less than one gram) can be detonated by means of a nonexplosive stimulus such as flame, spark, heat, or impact. Primary explosives are required to be sensitive to detonation by at least one of these types of stimuli. It is also possible that a particular explosive can be detonated by flame, but is insensitive to detonation by impact.

Accordingly, it is an object of the present invention to provide explosive initiating devices containing a reliable primary explosive that is less sensitive to initiation by impact and static electricity than commonly-used materials such as lead azide and lead styphnate.

Another object of the present invention is to provide a shock insensitive primary component for an explosive train employed in an explosive initiator.

A further object of the present invention is to provide a new and novel insensitive primary explosive component for an initiating device.

SUMMARY OF THE INVENTION

According to the present invention, the foregoing and additional objects are attained by providing an initiating device having a hydrated picric acid salt as the primary explosive component. This explosive is initiated by means of the heat produced by a quantity of a flame-sensitive thermite-type pyrotechnic igniter in an explosive train. Many of the metal salts of picric acid are sensitive to friction, impact and heat, however some of the hydrated metal salts of picric acid are insensitive to shock but can be initiated at elevated temperatures. The initiating devices of the present invention utilize these picric acid salts of various metals and hydration states to provide shock insensitive explosive initiators.

BRIEF DESCRIPTION OF THE DRAWINGS

A more complete appreciation of the invention and many of the attendant advantages thereof will be more readily apparent as the same becomes better understood with reference to the following detailed description when considered in connection with the accompanying drawings, wherein.

DETAILED DESCRIPTION

Figure 1:
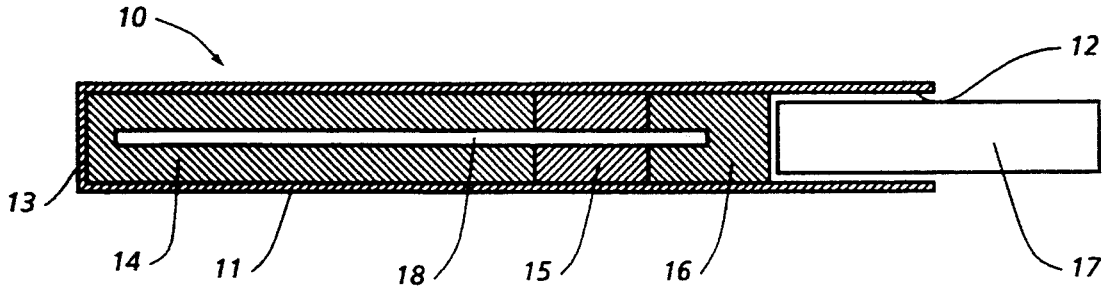
FIG. 1 is a schematic section of a shock insensitive explosive initiating device according to one aspect of the present invention.

Referring now to the drawings, and more particularly to FIG. 1, there is shown a schematic sectional view of one shock insensitive explosive initiating device according to the present invention and designated generally by reference numeral 10. Initiator 10 includes an elongated thin metal casing 11 having an open end 12 and a closed end 13. A quantity of a hydrated metal picrate charge 14 is disposed within metal casing 11 adjacent the closed end thereof. Charge 14 extends substantially half the length of metal casing 11 and abuts against, and is compactly sealed therein by, an inert pressure plug 15. A thermite igniter composition charge 16 abuts the other end of inert plug 15 and an igniter fuze cord 17 extends through opening 12 in metal casing 11 to terminate adjacent the thermate igniter composition charge 16. Inert pressure plug 15 is formed of hard rubber, nylon, or any suitable thermoplastics material, that is compatible with metal casing 11, charge 14, igniter composition charge 16 and igniter transfer fuze length 18.

Igniter transfer fuze 18, consists of a length of a braided metal wire, consisting of a heat-producing metal mixture that forms an alloy or otherwise reacts exothermically when heated by the thermate composition. One end of transfer fuze 18 is embedded in the thermite igniter charge 16, the second end is embedded within the hydrated metal picrate charge 14 and an intermediate portion extends through the inert pressure plug 15. The heat and hot particles produced upon ignition of wire transfer fuze 18 causes the hydrated metal picrate charge to initiate.

In a specific example of the initiator 10, metal casing 11 was a copper shell having a one/quarter inch outside diameter; six inches in length; and having a wall thickness of 0.033 inch. The hydrated metal picrate charge 14 was barium picrate hydrate; thermite igniter composition 16 consisted of red iron oxide, silicon, and boron (6:1:1 by weight); and the extruded metal ignition transfer fuze 18 consisted of palladium metal with 5% ruthenium over an inner core of aluminum metal. This material 18 is commercially available under the tradename PYROFUZE, from the Pyrofuze Corporation, an affiliate of the Sigmund Cohn Corporation, Mount Vernon, N.Y.

Figure 2:
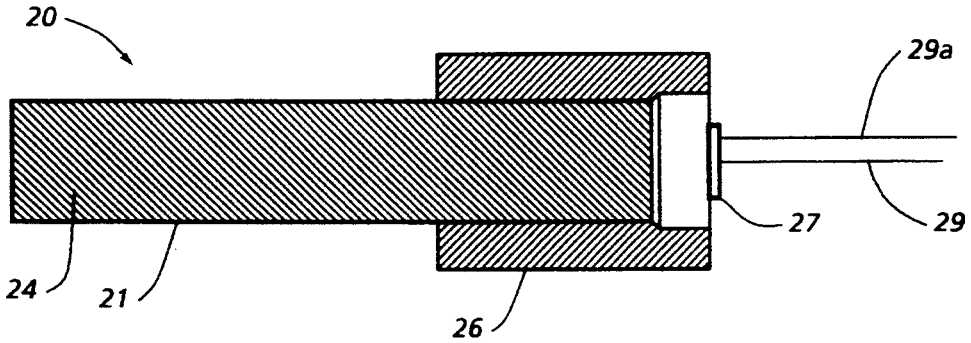
FIG. 2 is a schematic section of a shock insensitive explosive initiating device according to another aspect of the present invention.

Referring now more particularly to FIG. 2, a schematic sectional view of another shock insensitive explosive initiating device according to the present invention is shown and designated generally by reference numeral 20. Initiator 20 includes a metal casing 21 having a hydrated metal picrate charge 24 sealed therein. A cup-shaped thermite igniter composition charge 26 is disposed around an end, and extends over a portion of the length of metal casing 21. An electric match 27 abuts the thermite igniter composition charge 26. Lead wires 29, 29*a* connect with electric match 27 and a suitable ignition current supply, not shown, in a conventional manner.

Figure 3:
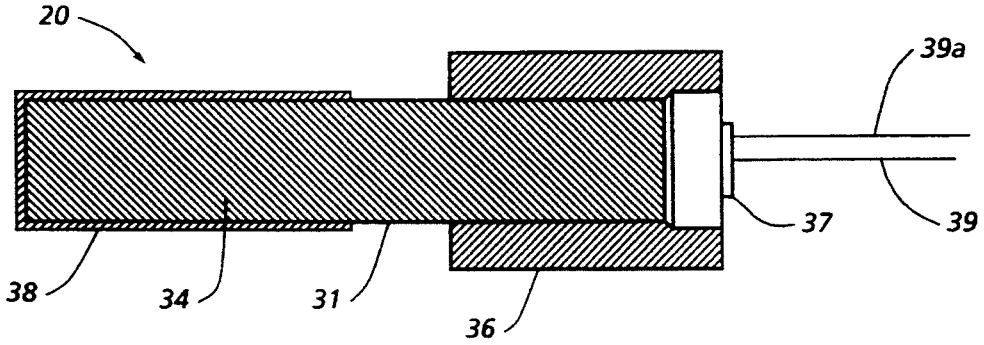
FIG. 3 is a schematic section of a shock insensitive explosive initiating device according to still another aspect of the present invention.

Referring now more particularly to FIG. 3, a schematic sectional view of another shock insensitive explosive initiating device according to the present invention is shown and designated generally by reference numeral 30. Initiator 30 includes elongated metal casings 31 and 38, each casing having an open and a closed end. A hydrated metal picrate charge 34 is disposed within the closed end, and has a portion thereof extending from the open end, of elongated metal casing 31. A cup-shaped thermite igniter composition charge 36 is disposed around the closed end, and extends over a portion of the length of elongated metal casing 31, as in the embodiment of FIG. 2. A cup-shaped metal casing 38, formed of a 50:50 zinc/tin alloy and having a wall thickness of 0.046 inch, is disposed around the open end of elongated metal casing 31, and contains the portion of hydrated metal picrate charge 34 extending from elongated metal casing 31. An electric match 37 abuts the thermite igniter composition charge 36. Lead wires 39, 39*a* connect with electric match 37 and a suitable ignition current supply, not shown, in a conventional manner.

Initiating device 30 is specifically designed for use in areas subject to high heat or fires. The hydrated metal picrate loses water of hydration and burns upon exposure to a flame in an open, unconfined state. A sealed unit containing hydrated metal picrate that is very rapidly (almost instantaneously) heated to a temperature well above its explosion temperature of approximately 341° C. explodes with violence. A thermite-type mixture 36 produces a flame temperature in excess of 1500° C. (since molten iron is produced), and hence causes the hydrated metal picrate 34 to explode in a closed tube consisting of elongated casing 31 and cup shaped casing 38.

In a fire scenario, as the flames and heat of the fire approach a device containing initiating device 30, there will be a gradual temperature rise, and upon reaching 200° C., the tin/zinc alloy casing 38 will melt, opening the system. The hydrated metal picrate 34 begins to decompose and burn, but does not explode since the confinement is lost. In an operational situation, ignition of thermite igniter composition charge 36 is an instantaneous reaction leaving no time for heat transfer down the copper casing 31 to melt the tin/zinc alloy shell 38 before explosion of the hydrated metal picrate charge 34 takes place.

In each of the embodiments of FIGS. 1, 2 and 3, a specific example hydrated metal picrate charge employed was barium picrate hydrate. The barium picrate hydrate employed is known to exist as the mono, di, penta, and hexa forms. A thermal curve of the barium picrate hydrate synthesized for the initiating devices revealed endotherms at 52.0° C., 112.3° C., 130.2° C. and 217.0° C. and a very small endotherm at 239.2° C. The test sample exploded at 341.3° C. The sample was run on a DuPont 9900 Differential Thermal Analyzer at 50° C./minute. After drying the sample for 24 hours at 70° C., all the endotherms were still distinguishable but were very weak.

Sensitivity tests run on the undried barium picrate hydrate showed this compound to be insensitivity to impact, friction and spark as follows:

Impact height for 50% detonation, 155 cm; while the impact height for 50% detonation of TNT is 100–120 cm. Friction sensitivity tests employing internationally known test procedures with a BAM instrument (Bundesanstalt für Materialforshung und-Prufüng) indicated that the barium picrate hydrate was not a primary explosive, and spark sensitivity, (joule at 510 ohms) was at 1.0 or the maximum for the instrument employed.

Sensitivity tests were not run on the barium picrate hydrate which had been dried for 24 hours at 70° C., but small crystals of this material would not explode when placed on a metal plate and pounded with a hammer.

Although barium picrate salt was used for the specific examples and tests described, the invention is not so limited and other hydrated metal picrate salts from Groups II–VIII in the Periodic Table could also be used in practice of the present invention. These additional Group II hydrated metal picrate salts include, but are not limited to, calcium picrate hydrate, aluminum picrate hydrate, magnesium picrate hydrate, iron picrate hydrate and nickel picrate hydrate.

The thermite igniter composition 16, 26 and 36 described hereinbefore in reference to the specific embodiments of FIGS. 1, 2 and 3, respectively, consisted of a mixture of red iron oxide, silicon, and boron molded in a 6:1:1 ratio, by weight, and is readily ignited by, either the spit from a burning fuze 17, as illustrated in FIG. 1, or by an electric match 27 or 37, as illustrated in FIGS. 2 and 3, respectively.

Metal casing 11, 21 and 31, containing respective hydrated metal picrate charges 14, 24 and 34 in the specific embodiments of FIGS. 1, 2 and 3 were constructed of 0.033 inch thickness, one/quarter inch outside diameter, copper tubing, cut to approximately six inch lengths and provided with conventionally sealed ends thereon (FIGS. 2) when filled with the hydrated metal picrate charges. Metal casings 11, 21 and 31 may also be formed of aluminum, if so desired. In the embodiment of FIG. 3, the tin/zinc alloy cup 38 is provided with an internal diameter substantially equal to the outside diameter of casing 31 to permit a press fitting closure between the parts.

In view of the foregoing description and specific examples, it is readily seen that the present invention provides a novel class of initiating devices that have the principle advantages of greater reduced shock, friction and static sensitivity as compared to conventional initiating devices. Also, the logistics of manufacturing, shipping, storing and use of the insensitive initiating devices of the present invention is greatly reduced and will have a positive impact on cost.

Although the invention has been described in reference to specific examples, it is to be understood that these examples are given as exemplary and are not to be deemed as exhaustive. Obviously, there are numerous variations and modifications of the present invention that will be readily apparent to those skilled in the art in the light of the above teachings. It is therefore to be understood that, within the scope of the appended claims, the invention may be practiced other than as specifically described herein.

What is claimed as new and desired to be secured by Letters Patent of the United States is:

1. A shock insensitive explosive initiating device comprising:

an elongated metal casing having an open end and a closed end;

a quantity of a hydrated metal picrate disposed within said elongated metal casing adjacent the closed end thereof;

an inert pressure plug disposed within said elongated metal casing and abutting said quantity of hydrated metal picrate;

a quantity of thermite igniter composition disposed within and adjacent said open end of said elongated metal casing;

said quantity of thermite igniter composition being in abutting relationship with said inert pressure plug and provided with an exposed surface;

an elongated heat generating fuze element having a first end embedded within said quantity of thermite igniter composition, a second end embedded within said hydrated metal picrate, and an intermediate portion extending through said inert pressure plug; and ignition means disposed within said open end of said elongated metal casing and in abutting relationship with said thermite igniter composition.

2. The shock insensitive explosive initiating device of claim 1 wherein said elongated metal casing having a quantity of hydrated metal picrate disposed therein is a thin copper tube and said ignition means disposed in abutting relationship with said thermite igniter composition is selected from the group of ignition means consisting of an electric match and a flame producing fuze cord.

3. The shock insensitive explosive initiating device of claim 1 wherein said thermite igniter charge is a composition consisting of red iron oxide, silicon and boron composition in a 6:1:1 ratio, by weight.

4. The shock insensitive explosive initiating device of claim 1 wherein said elongated heat generating fuze element includes an extruded wire consisting of aluminum and palladium.

5. The shock insensitive explosive initiating device of claim 1 wherein said hydrated metal picrate is selected from the group of hydrated metal picrates consisting of barium picrate hydrate, calcium picrate hydrate, aluminum picrate hydrate, magnesium picrate hydrate, iron picrate hydrate and nickel picrate hydrate.

6. The shock insensitive explosive initiating device of claim 1 wherein said hydrated metal picrate is barium picrate hydrate.

7. A shock insensitive explosive initiating device comprising:

an elongated metal casing having a quantity of a hydrated metal picrate disposed therein;

a cup-shaped thermite igniter composition charge disposed around an end of said elongated metal casing and extending over a portion of the length of said elongated metal casing; and ignition means disposed in abutting relationship with said thermite igniter composition charge.

8. The shock insensitive explosive initiating device of claim 7 wherein said hydrated metal picrate is barium picrate hydrate and said ignition means is selected from the group of ignition means consisting of a flame producing fuze cord length and an electric match.

9. The shock insensitive explosive initiating device of claim 7 wherein said cup-shaped thermite ignition charge consists of a 6:1:1 ratio, by weight, of red iron oxide, silicon and boron.

10. The shock insensitive explosive initiating device of claim 7 wherein said elongated metal casing having a quantity of a hydrated metal picrate disposed therein is provided with an open end and a closed end; said hydrated metal picrate filling said closed end and extending from said open end of said elongated metal casing; a cup-shaped metal casing disposed over and secured to said open end of said elongated metal casing and encasing said hydrated metal picrate extending from said open end of said elongated metal casing; said thermite igniter composition charge being disposed around said closed end of said elongated metal casing; said cup-shaped metal casing having a melting point substantially less than the ignition temperature of said hydrated metal picrate contained therein and in said elongated metal casing whereby, when exposed to a fire external to said shock insensitive explosive initiating device, said cup-shaped metal casing will melt and expose said hydrated metal picrate from confinement and thereby permit burning, while preventing explosion, of said hydrated metal picrate contained therein.

11. The shock insensitive explosive initiating device of claim 10 wherein said cup-shaped metal casing secured to said elongated metal casing is constructed of a tin/zinc alloy and has a melting point of approximately 200° C.

12. The shock insensitive explosive initiating device of claim 11 wherein said hydrated metal picrate is barium picrate hydrate and has an ignition temperature of approximately 341° C.

13. A shock insensitive explosive initiating device comprising:

an elongated first metal shell having an open end and a closed end and having a quantity of a hydrated metal picrate ignition charge disposed within said closed end and extending from said open end;

a second metal shell disposed over said open end of said first elongated first metal shell and encasing the portion of said hydrated metal picrate ignition charge extending therefrom;

a thermite igniter composition charge disposed over said closed of said elongated first metal; and ignition means disposed in abutting relationship with said thermite igniter composition.

14. The shock insensitive explosive initiating device of claim 13 wherein said elongated first metal shell is formed of a metal selected from the group of metals consisting of copper and aluminum.

15. The shock insensitive explosive initiating device of claim 13 wherein said second metal shell has a melting point substantially below the explosion temperature of said hydrated metal picrate ignition charge.

16. The shock insensitive explosive initiating device of claim 15 wherein said second metal shell has a melting point of approximately 200° C. and said hydrated metal picrate ignition charge is barium picrate hydrate having a combustion temperature of approximately 341° C.

17. The shock insensitive explosive initiating device of claim 13 wherein said second metal shell is a 50:50 tin/zinc alloy shell having a melting point of approximately 200° C.

18. The shock insensitive explosive initiating device of claim 13 wherein said hydrated metal picrate ignition charge is selected from the group of hydrated metal picrate ignition charges consisting of barium picrate hydrate, calcium picrate hydrate, aluminum picrate hydrate, magnesium picrate hydrate, iron picrate hydrate and nickel picrate hydrate.

19. A shock insensitive explosive train initiating device comprising:

a thin elongated, metal casing;

a quantity of a hydrated metal picrate disposed within said thin elongated copper casing;

a thermite igniter composition disposed adjacent said quantity of a hydrated metal picrate;

ignition means disposed adjacent said thermite igniter composition whereby, upon activation, said ignition means ignites said thermite igniter composition and said thermite igniter composition ignites said hydrated metal picrate.

20. The shock insensitive explosive train initiating device of claim 19 wherein said hydrated metal picrate is barium picrate hydrate; said thermite igniter composition consists of a 6:1:1 ratio, by weight of red iron oxide, silicon and boron; and said ignition means is selected from the group of ignition means consisting of an electric match and a flame producing fuze cord length.

* * * * *